US005095780A

United States Patent [19]

Beuke

[11] Patent Number: 5,095,780

[45] Date of Patent: Mar. 17, 1992

[54] PRESSURE-OPERATED POWER WRENCH

[75] Inventor: Karl Beuke, Neunkirchen-S., Fed. Rep. of Germany

[73] Assignee: Paul-Heinz Wagner, Fed. Rep. of Germany

[21] Appl. No.: 640,724

[22] Filed: Jan. 14, 1991

[30] Foreign Application Priority Data

Jan. 13, 1990 [DE] Fed. Rep. of Germany ..... 4000815

[51] Int. Cl.[5] ..... B25B 13/46

[52] U.S. Cl. ..... 81/57.39; 81/57.44

[58] Field of Search ..... 81/57.39, 57.44

[56] References Cited

U.S. PATENT DOCUMENTS 4,805,496 2/1989 Wagner et al. ..... 81/57.39
5,003,847 4/1991 Wagner ..... 81/57.39
5,005,447 4/1991 Junkers ..... 81/57.39

*Primary Examiner*—James G. Smith
*Attorney, Agent, or Firm*—Diller, Ramik & Wight

[57] ABSTRACT

The pressure-operated power wrench is provided with an annular member (14) rotatably supported within a headpiece (10). The annular member (14) can be coupled to the bolt to be rotated and is taken along in a moving direction by a ratchet lever (18). The lever (18) is actuated by a hydraulically moved piston (40). The piston (40) has a first piston face (45) and a second piston face (47) arranged coaxially thereto. When the load moment is small, only the first piston face (45) is pressurized. When this pressure exceeds a limit value, a back-check valve (57) is opened whereby also the second piston face (47) is pressurized. In the phase wherein rotation for tightening a bolt is still easy, only a small quantity of oil need be moved. Thus, power and heat losses are small. Further, the easy-rotating phase is abbreviated by fast reciprocation of the piston.

8 Claims, 5 Drawing Sheets

Figure 1:
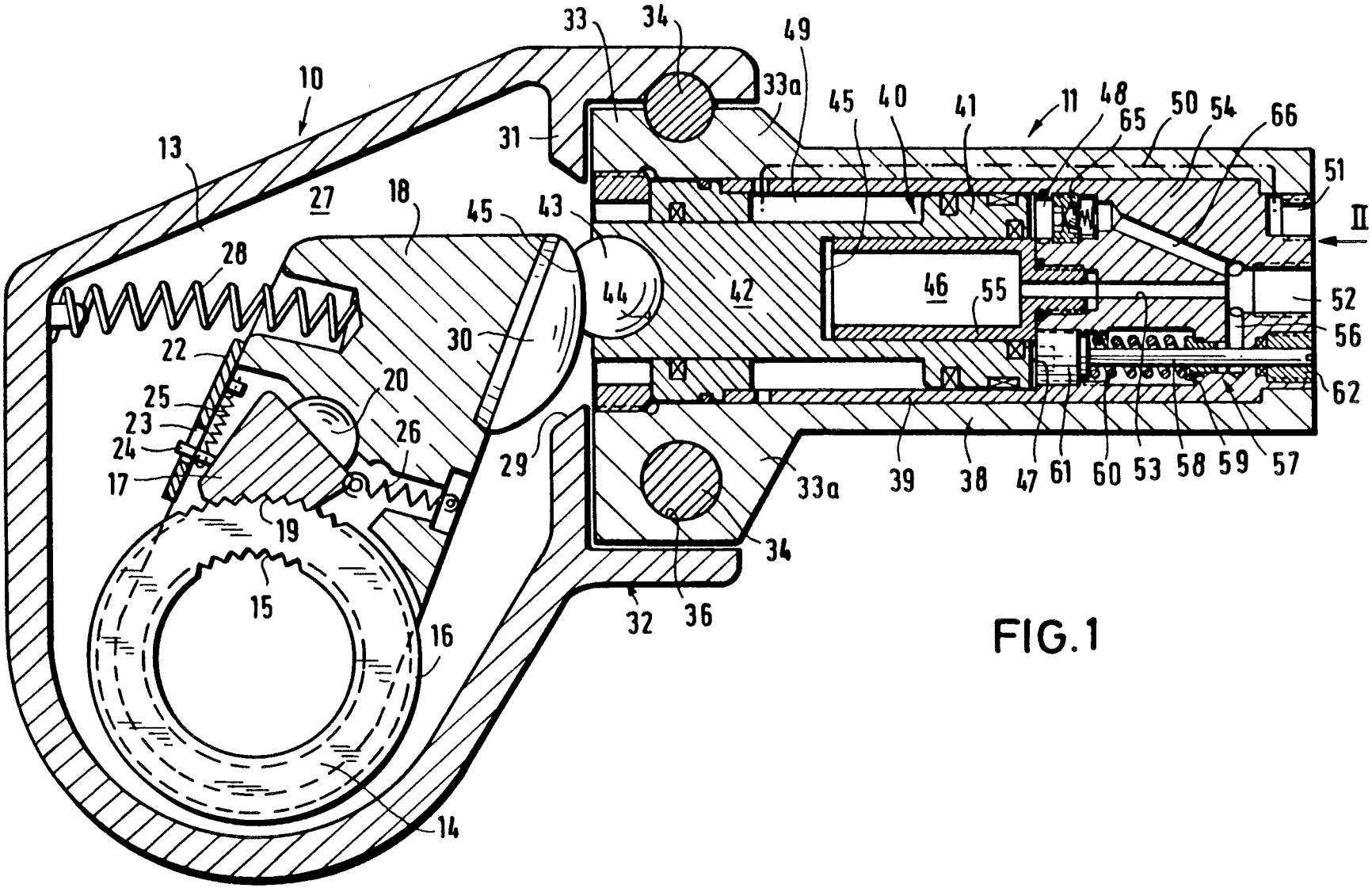

FIG. 2
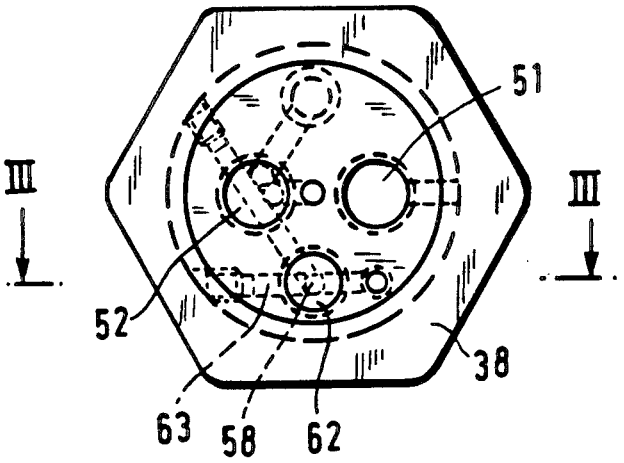
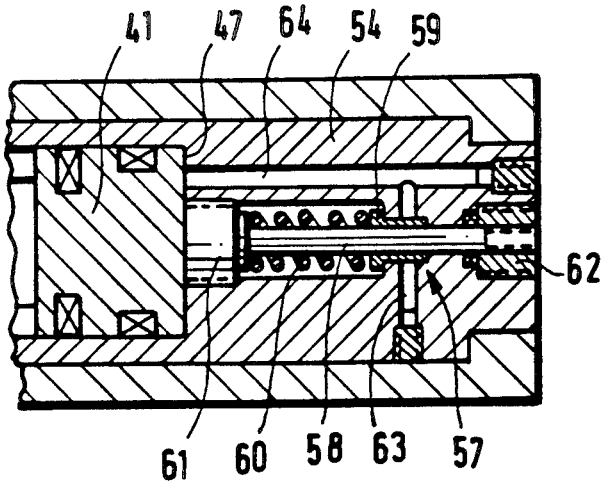
FIG. 3

PRESSURE-OPERATED POWER WRENCH

The invention is directed to a pressure-operated power wrench.

Power wrenches are provided with a headpiece having an annular member rotatably supported thereon. The annular member is engaged by a lever including a ratchet, which lever can be pivoted by the power of a hydraulic piston displaceably arranged in a cylinder. The unit consisting of the piston and the cylinder can be a single-acting unit wherein the piston is pushed into its retracted position by a spring, or a double-acting unit wherein the pressure chamber is provided on one side of the piston and a counterpressure chamber is provided on the other side, with the pressure chamber and the counterpressure chamber being alternately pressurized and depressurized.

Known hydraulic power wrenches suffer from the disadvantage that, in a working stroke, the whole pressure chamber on the one side of the piston has to be filled with pressure oil. Due to the hydraulic resistance of the line feeding the pressure chamber and due to the valves contained in said line, the pressurizing of the pressure chamber requires a relatively long time with each working stroke. In the initial phase of the rotating of a bolt, the load moment of the bolt is small, so that already a relatively small force would be sufficient for moving the piston. Nevertheless, during each working stroke, the whole pressure chamber is filled with pressure oil. This relatively large oil throughput, with a large quantity of oil being pressed through hoses and valves, further results in the oil being excessively heated. Thus, in the pressure aggregate, consisting of a compressor and a pressure container, there is required a correspondingly large cooling capacity whereby the pressure aggregate becomes expensive and bulky.

It is an object of the invention to provide a hydraulic power wrench wherein the time required for rotating a bolt and the power required for the pressure aggregate are decreased.

In the power wrench according to the first solution, the piston has two piston faces on the side of the pressure chamber. When the load moment is small, only one of said piston faces is pressurized so that, during small load moments, only a relatively small oil throughput is required for moving the piston. When the load moment increases and the power of the pressure acting on the first piston face is not sufficient for moving the piston, the same pressure is exerted also on the second piston face. Since the powers acting on the two piston faces are combined now, the piston is advanced by an increased force so that the bolt can be fixed with the required high rotational moment. A similar effect is used for loosening a bolt. When loosening a bolt, the larger moment of rotation has to be applied in the initial phase of rotating the bolt whereas, in the end phase, the load moment is relatively small so that the power wrench works exclusively by the force of the first piston face.

The pressure connection of the cylinder, which is pressurized in the working stroke, is connected, on the one hand, directly to the first piston face, and on the other hand, it is connected to the second pressure face of the piston through an excess-pressure valve that opens only when a limit value is exceeded. When the load is small, the excess-pressure valve, whose limit value is suitably adjustable, remains closed so that each working stroke of the piston requires only a small hydraulic power and a small quantity of oil is sufficient for moving the piston. When the load is large, however, the effective piston face is increased and the hydraulic power is raised.

Preferably, the piston has two piston faces which can be switched into the operative state in steps. Of course, also more than two piston faces can be provided to be made operative sucessively in response to different limit pressures.

In the power wrench according to the second solution, the piston comprises two piston members displaceable relative to each other. When the load is small, only the first piston member is moved while the second piston member is retained by a yielding counterpressure means. When the load is large, the pressure in the pressure member increases to such an extent that the force of the counterpressure means is exceeded so that, in addition to the first piston member, also the second piston member is moved and the forces of both piston members are combined.

The counterpressure means can consist of a restrictor member (throttle) in the return duct leading out of the counterpressure chamber of the cylinder. Such a restrictor member has a delaying effect, i.e. it allows movement of the second piston member only when the second piston member has been subjected to an advance force for a certain time period. If the lever has not been moved within this time, the second piston member additionally presses against the first piston member.

The counterpressure means can also be a spring which, during pressure build-up in the pressure chamber, still retains the second piston member but gives in when the pressure is further increased.

Also, it is possible to provide the counterpressure means as a locking device adapted to mechanically retain the second piston member and to be mechanically disengaged for releasing the second piston member.

Suitably, pressurization of the piston is controlled, in dependence of the distance covered, by providing limit switches on the cylinder which are actuated when the piston has reached its front and/or rear end position and which then switch the valve of the pressure duct so that the piston starts moving in the opposite direction.

The invention is applicable in single-acting cylinders with reciprocal pressurization as well as in single-acting cylinders provided for unilateral pressurization only and having a return spring.

The invention is preferably used in hydraulically operated power wrenches but is also suitable for pneumatically operated power wrenches.

Embodiments of the invention will be described in greater detail hereunder with reference to the drawings.

In the drawings

Figure 4:
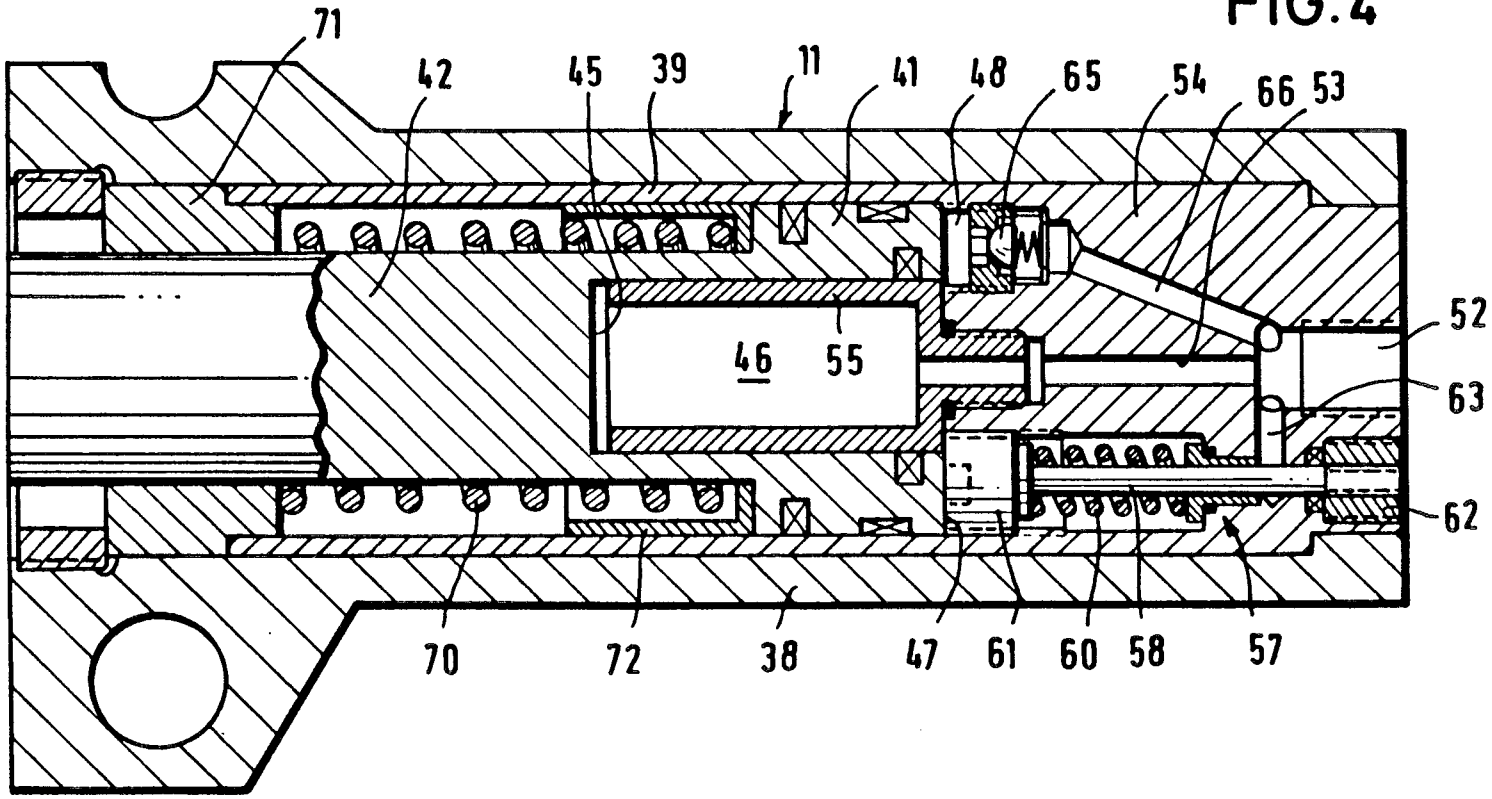
Figure 5:
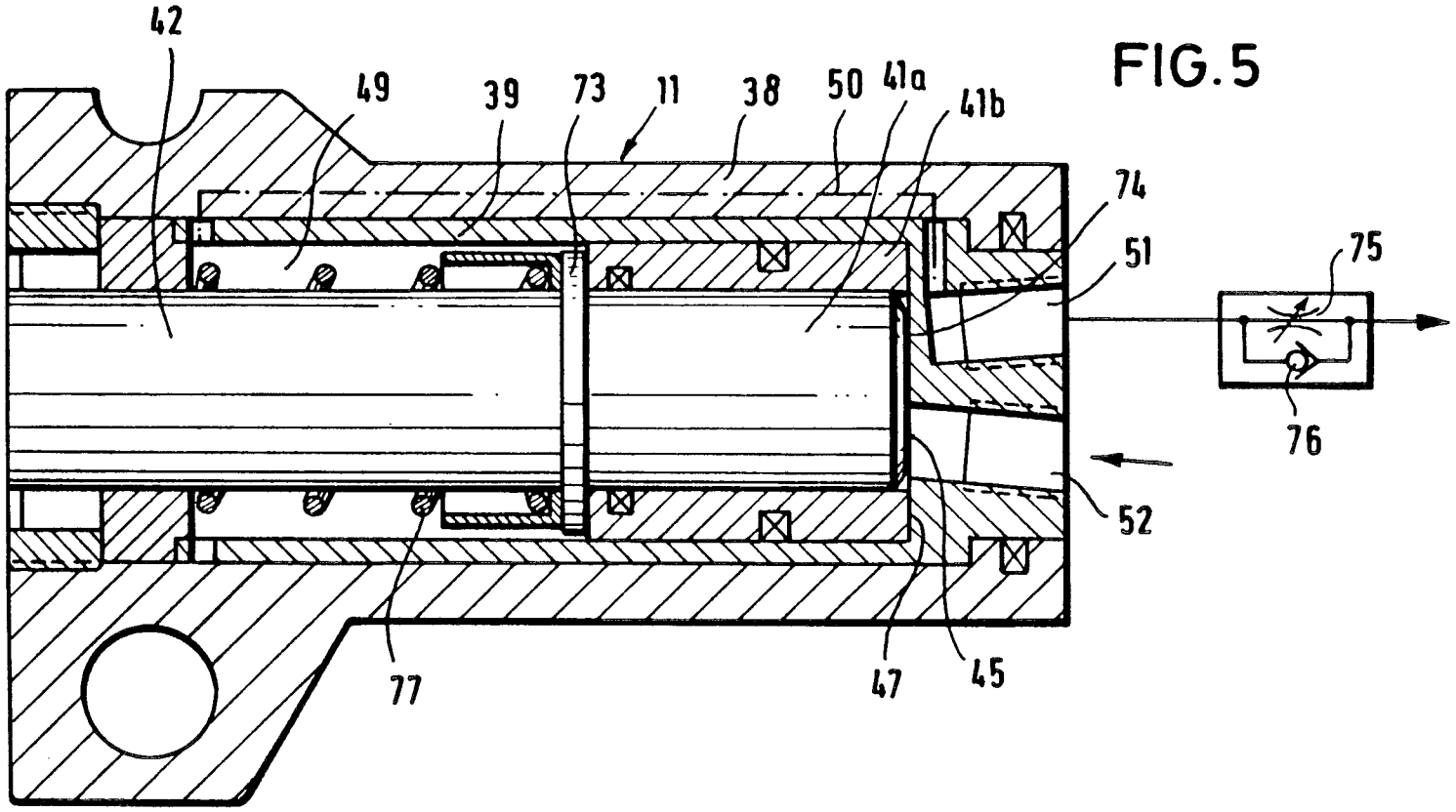
Figure 6:
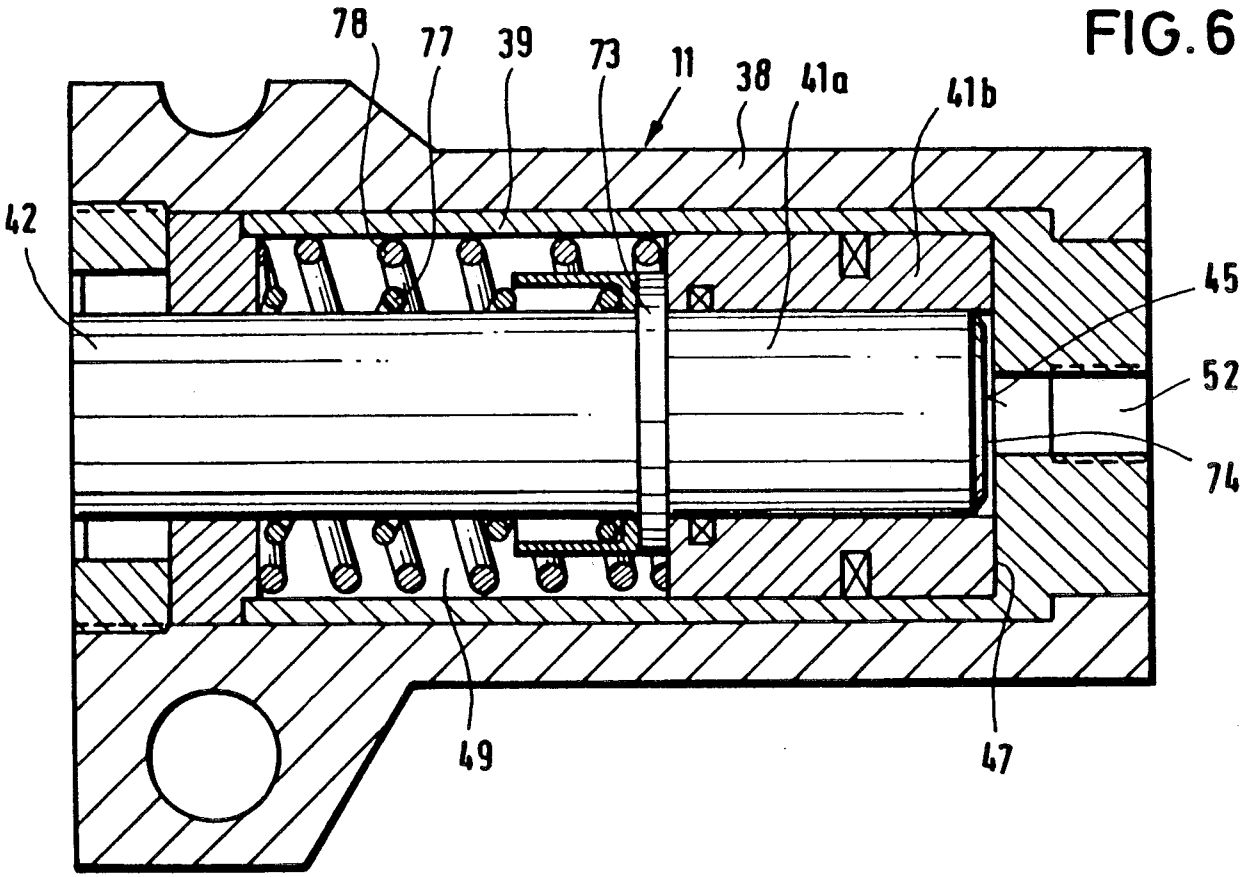

FIG. 1 is a schematic sectional view of a power wrench having a piston-cylinder unit according to a first embodiment, FIG. 2 is a front view of the power wrench as seen from the direction of arrow II in FIG. 1, FIG. 3 is a sectional view along the line III—III in FIG. 2, FIG. 4 shows a second embodiment of the first variant of the power wrench, having a single-acting cylinder and a return spring, FIG. 5 shows a first embodiment of the second variant, having two piston members movable relative to each other and a double-acting cylinder, and FIG. 6 shows a second embodiment of the second variant, having a single-acting cylinder.

The power wrench of FIGS. 1-3 consists of a headpiece 10 and a cylinder housing 11. The headpiece 10 is provided with two parallel end walls 13. The end walls 13 have bores formed therein for bearing a rotatable annular member 14. Annular member 14 has an inner profile 15 for receiving a shaft (not shown). Said shaft has an outer profile corresponding to the inner profile 15, and can be inserted from both sides of headpiece 10. Further, the shaft protrudes from headpiece 10 to one side or both sides and carries a button die for connecting the shaft under rotational strength to the rotated screw head.

A ratchet member 17 cooperates with an outer toothing 16 of annular member 14. Ratchet member 17 consists of a wedge-shaped ratchet shoe and is arranged in a recess of lever 18. The lever 18 is arranged coaxially to annular member 14 and can be pivoted relatively to the annular member about the common axis of the two parts. A concave toothed face 19 of ratchet member 17 engages into the outer toothing 16 of annular member 14. The rear end of ratchet member 17 is supported on the plane surface of a hemispherical pressure member 20 seated in a ball pan of lever 18. Ratchet member 17 can freely adjust itself to the outer toothing 16 in all directions. Orientation of ratchet member 17 is such that, upon movement of annular member 14 in one rotational direction, ratchet member 17 lifts off from outer toothing 16 so that annular member 14 can be freely rotated in this direction, and that, upon movement of annular member 14 in the opposite direction, annular member 14 is arrested by the toothing of ratchet member 17.

Lever 18 has fastend thereto a plate 22 covering the recess of lever 18. Plate 22 has a guiding slot 23 for guiding a pin 24 projecting from ratchet member 17. Further, a spring 25 is fastened to plate 22, the end of spring 25 engaging with pin 24 and thus pulling the outer end of ratchet member 17. Another spring 26, being fastened to lever 18, engages the inner end of ratchet member 17 for bringing the inner end of toothed face 19 in engagement with outer toothing 16.

The annular member 14 and the lever 18 are accommodated in a receiving chamber 27 of the housing of headpiece 10. A spring 28 is supported on a wall of headpiece 10, pressing against lever 18 and pushing the lever in the direction of an opening 29 of receiving chamber 27. Lever 18 is provided, on the side facing the opening 29, with a spherical pressure member 30 whose outer surface forms the pressure face of lever 18 for engaging the piston. The wall 31, defining the opening 29 and limiting the receiving chamber 27, is joined by the holding means 32 of headpiece 10 for receiving an insert portion 33 provided at the front end of cylinder housing 11. The insert portion 33 has two projections 33*a* projecting in opposite directions from a cylindrical portion of cylinder housing 11. The hollow profile of holding means 32 is adapted to the peripheral profile of insert portion 33 so that the insert portion 33 fills the hollow space of holding means 32. For locking cylinder housing 11 to headpiece 10, there are provided locking members 34, shaped as cylinder pins and extending through suitable openings 35 of holding means 32 and through corresponding openings 36 of the projections 33*a*. The locking members 34 can be easily pulled out from the openings 35 and 36 if cylinder housing 11 is to be separated from headpiece 10.

The cylinder housing 11 has an outer casing 38 being integral with the insert portion 33 and serving as a burst protection member. Casing 38 accommodates an hydraulic cylinder 39 having piston 40 slideably supported therein. Piston 40 consists of a piston body 41 and a piston rod 42 projecting from piston body 41. A pressure member 43 is arranged at the front end of piston rod 42. Pressure member 43 is supported in a ball pan 44 of piston rod 42 and has a concave spherical face 45 with its curvature adapted to the convex curvature of pressure member 30. Due to the force of spring 28, pressure member 30 is pressed against pressure member 43 so that lever 18 is kept in abutment against piston 40, without any drawing connection between these parts being provided to this purpose. The piston body 41 has two piston faces to be separately pressurized, i.e. a piston face 45 forming the end wall of a pocket bore 46, and an annular piston face 47 surrounding said bore. An annular pressure chamber 48 is limited by piston face 47. At the opposite side of piston body 41, there is arranged an annular counterpressure chamber 49 surrounding piston rod 42 and being connected, through a duct 50, to a front-end connection 51 of casing 38. The other connection 52 communicates with a bore 53 extending through the end wall 54 of casing 38. A threaded bore of end wall 54 receives the connecting portion of a sleeve 55 projecting into pocket bore 46 of piston 40. The length of sleeve 55 is such that, with each position of piston 40, sleeve 55 is immersed into pocket bore 46. The bore 53 extends through the connecting portion of sleeve 55 into pocket bore 46.

Further, connection 52 is connected, through a transverse bore 56, with an excess-pressure valve 57 being provided with a shaft 58 screwed into end wall 54, a valve body 59 surrounding said shaft and being movable in the longitudinal direction of the shaft, a spring 60 pressing against an abutment around valve body 59, and a head 61 of shaft 58 for supporting the spring 60. By rotating the shaft 58 in a threaded bush 62, the biasing force of spring 60 and thus the actuating force of excess-pressure valve 57 can be varied.

When the pressure within bore 56 exceeds the limit value, valve body 59 is displaced against the force of spring 60 in the direction of head 61. Thereby, bore 56 is connected to a further transverse bore 63 (FIG. 3) communicating with a longitudinal bore 64 of end wall 54. Said longitudinal bore 64 leads to the annular second piston face 47.

A spring-loaded back-check valve 65 leads from pressure chamber 48 through a bore 66 to connection 52. The back-check valve 65 is locked in the direction leading from connection 52 to pressure chamber 48 and is switched into the opened state when the pressure in pressure chamber 48 exceeds a limit value.

When the force exerted by lever 18 on piston 40 is small, piston 40, due to the pressure in connection 52, is moved in the direction of lever 18, advance movement of the piston being caused by the pressure prevailing on the first piston face 45. The oil contained in counterpressure chamber 49 is pressed out through duct 50 to connection 51 which is pressureless in this condition. In the return stroke of the piston, connection 51 is connected to the pressure source while connection 52 is pressureless. In this constellation, pressure enters into counterpressure chamber 49 while pocket bore 46 is pressureless by the effect of connection 52. Thereby, piston 40 moves back into the left end position, while oil is driven out of pressure chamber 48 through backcheck valve 65 to the pressureless connection 52.

When, in a working stroke, the pressure acting on the piston face 45 is not sufficient for moving the piston, the pressure in connection 52 increases until exceeding the limit pressure of excess-pressure valve 57. When this is the case and the excess-pressure valve 57 is opened, the pressure enters pressure chamber 48 via bores 63 and 64 so that, in addition to the first piston face 45, also the second piston face 47 is pressurized. Also a hand-operated valve can be used instead of excess-pressure valve 57.

The embodiment according to FIG. 4 largely corresponds to the first embodiment, except for the fact that the piston 40 of FIG. 4 is subjected to hydraulic pressure only from one side while the counterpressure or the return force is applied by a spring 70. Spring 70 surrounds piston rod 42, is supported on a front wall 71 of cylinder casing 38 and has its other end pressing against the annular face of piston body 41. At piston body 41, spring 70 is surrounded by a guide bush 72.

In this embodiment, casing 38 is provided with only one connection 52 being alternately pressurized and depressurized. When the load is small, pressure is applied—through bore 53—only onto piston face 45 while excess-pressure valve 57 maintains its locked position. When the load is larger and the pressure in connection 52 is increased beyond the limit value, excess-pressure valve 57 opens. Thus, similar to the first embodiment, pressure is conveyed into the annular pressure chamber 48 so that, in addition to the first piston face 45, also the annular second piston face 47 is pressurized. Return movement of piston 40 is effected by spring 70 when connection 52 is pressureless. In this case, the pressure oil is urged out of pocket bore 46 via bore 53 and out of pressure chamber 48 via back-check valve 56 and bore 66.

In both embodiments, the length of sleeve 55 and the length of pocket bore 46 are larger than the maximum piston stroke so that sleeve 55 and pocket bore 46 sealingly engage each other in each axial position of the piston.

In the embodiment of FIG. 5, the piston body consists of a cylindrical first piston member 41*a*, being integrally connected to piston rod 42 and having an annular collar 73, and of an annular second piston member 41*b* sealingly surrounding the first piston member 41*a* and being sealed also against cylinder 39. The first piston face 45 consists of the rear end of the first piston member 41*a*, and the annular second piston face 47 consists of the end wall of the annular second piston member 41*b*. Connection 52 communicates with the pressure chamber 74 limited by both piston faces 45 and 47. The counterpressure chamber 49 is connected to connection 51 through a duct 50.

Connection 51, which in the working stroke is connected to the return system, is provided with a throttle 75 being connected in parallel to a back-check valve 76.

In a working stroke, both piston faces 45 and 47 are pressurized through connection 52 while connection 51 is pressureless. Thereupon, piston member 41*a* moves against the force of spring 77 in the direction of lever 18 (FIG. 1). The second piston member 41*b* is prevented from moving along with piston member 41*a* because the counterpressure chamber 49 contains oil which has to be pressed out through the throttle 75 into the discharge duct. Thus, when the load is small, only the first piston member 41*a* is moved and this movement is finished already before the start of the delayed movement of second piston member 41*b*. In case of a larger load, however, the first piston member 41*a* does not move. Only upon application of the additional force of the second piston member 41*b*, a piston movement, being accordingly slow, is effected, and the oil is pressed out of counterpressure chamber 49 through throttle 75.

Switching of connections 51 and 52 is carried out using limit switches (not shown). When the piston has reached the end of its working stroke, connection 51 is pressurized and connection 52 is made pressureless. In this situation, the pressure is conveyed, via the back-check valve 76 operative in pass direction, to connection 51 while bypassing the throttle 75. Thereby, counterpressure chamber 49 is pressurized, pressure chamber 74 being pressureless through connection 52.

The embodiment of FIG. 6 differs from the embodiment of FIG. 5 only in that the cylinder 39 is a single-acting cylinder having only one connection 52 being alternately pressurized and depressurized. For the return stroke of the piston, there are provided a first spring 77 pressing against a flange 73 of first piston member 41*a*, and a second spring 78 pressing against second piston member 41*b*. These springs 77 and 78 are arranged in counterpressure chamber 49 into which no oil can enter.

First, by the pressure at connection 52, the weaker spring 77 is compressed so that the first piston member 41*a* performs the working stroke. When the load is larger, so that the force on piston face 45 does not suffice for advancing the piston rod 42, pressure builds up in pressure chamber 74 to such an extent that the second piston member 41*b* is moved while spring 78 is being compressed. In this manner, lever 18 is pivoted. In the return stroke, connection 52 is made pressureless so that both piston members 41*a* and 41*b* are moved into their initial position by their respective springs.

I claim:

1. A pressure-operated power wrench having a headpiece (10) comprising a rotatably supported annular member (14) and a lever (18) engaging the annular member (14) for rotating the annular member (14), and a cylinder (39) containing a piston (40) for moving the lever (18), characterized in that the piston (40) has on one side thereof two piston faces (45,47) to be pressurized separately, one of said piston faces being pressurized only when the pressure acting on the other piston face (45) exceeds a limit value.

2. The power wrench according to claim 1, wherein both piston faces (45,47) are arranged coaxially and set off from each other in axial direction, and wherein an excess-pressure valve (57) is provided which allows pressurization of the second piston face (47) when the pressure acting on the first piston face (45) exceeds the limit value.

3. The power wrench according to claim 1, wherein a pressure chamber (48) defined in part by the piston (40) is connected, through a back-check valve (65) adapted to be opened in a direction leading away from the pressure chamber (48), to one of two switchable hydraulic connections (51, 52).

4. The power wrench according to claim 1, wherein the piston (40) has a bore (46) formed therein for slideably receiving a sleeve (55) fastend to the cylinder (39), the interior of said sleeve (55) being permanently connected to one of two switchable hydraulic connections (51,52).

5. A pressure-operated power wrench having a headpiece (10) comprising a rotatably supported annular member (14) and a lever (18) engaging the annular member (14) for rotating the annular member (14), and a cylinder (39) a piston (40) for moving the lever (18), characterized in that the piston (40) has two piston members (41*a*,41*b*) to be subjected to the same pressure and being displaceable relative to each other, one of the piston members pressing directly against the lever (18) and the other one of the piston members being supported on the first piston member (41*a*), and in that, when a pressure is built up, the second piston member (41*b*) is temporarily retained in its retracted position by a counterpressure means which includes a counterpressure chamber.

6. The power wrench according to claim 5, wherein the counterpressure means includes a throttle (75) connected to the counterpressure chamber (49) averted from a pressure chamber (74) of the cylinder (39).

7. The power wrench according to claim 6, wherein a back-check valve (76), to be opened towards the cylinder (39), is connected in parallel to the throttle (75).

8. The power wrench according to claim 5, wherein the counterpressure means comprises a spring (78) acting on the second piston member (41*b*).

* * * * *